US006579068B2

(12) United States Patent
Bridger et al.

(10) Patent No.: US 6,579,068 B2
(45) Date of Patent: Jun. 17, 2003

(54) METHOD OF MANUFACTURE OF A SUSPENDED NITRIDE MEMBRANE AND A MICROPERISTALTIC PUMP USING THE SAME

(75) Inventors: Paul M. Bridger, Pasadena, CA (US); Robert P. Strittmatter, Pasadena, CA (US); Robert A. Beach, Pasadena, CA (US); Thomas C. McGill, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 0 days.

(21) Appl. No.: 09/923,483

(22) Filed: Aug. 7, 2001

(65) Prior Publication Data

US 2002/0067992 A1 Jun. 6, 2002

Related U.S. Application Data

(60) Provisional application No. 60/224,106, filed on Aug. 9, 2000.

(51) Int. Cl.[7] ..... F04B 19/24; F04B 17/00

(52) U.S. Cl. ..... 417/53; 417/413.2; 417/413.1; 417/322

(58) Field of Search ..... 417/53, 413.2, 417/413.1, 413.3, 322, 475

(56) References Cited

U.S. PATENT DOCUMENTS 5,096,388 A * 3/1992 Weinberg ..... 417/413.3
5,529,465 A * 6/1996 Zengerle et al. ..... 417/413.2
5,659,171 A * 8/1997 Young et al. ..... 250/289
5,705,018 A * 1/1998 Hartley ..... 156/345.1
6,007,309 A * 12/1999 Hartley ..... 417/322
6,177,057 B1 * 1/2001 Purdy ..... 423/409
6,213,735 B1 * 4/2001 Henco et al. ..... 417/413.2

* cited by examiner

*Primary Examiner*—Charles G. Freay
*Assistant Examiner*—Michael K. Gray
(74) *Attorney, Agent, or Firm*—Daniel L. Dawes; Myers Dawes & Andras LLP

(57) ABSTRACT

A suspended p-GaN membrane is formed using photochemical etching which membrane can then be used in a variety of MEMS devices. In the illustrated embodiment a pump is comprised of the p-GaN membrane suspended between two opposing, parallel n-GaN support pillars, which are anchored to a rigid substrate below the pillars. The p-GaN membrane bows upward between the pillars in order to relieve stress built up during the epitaxial growth of membrane. This bowing substantially increases the volume of the enclosed micro-channel defined between membrane and substrate below. The ends of membrane are finished off by a gradual transition to the flat underlying n-GaN layer in which fluidic channels may also be defined to provide inlet and outlet channels to microchannel. A traveling wave or sequential voltage applied to the electrodes causes the membrane to deform and provide a peristaltic pumping action in the microchannel.

20 Claims, 4 Drawing Sheets

Fig. 2a
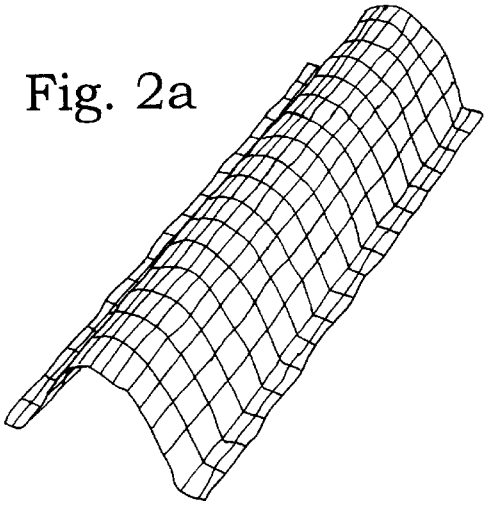
Fig. 2b
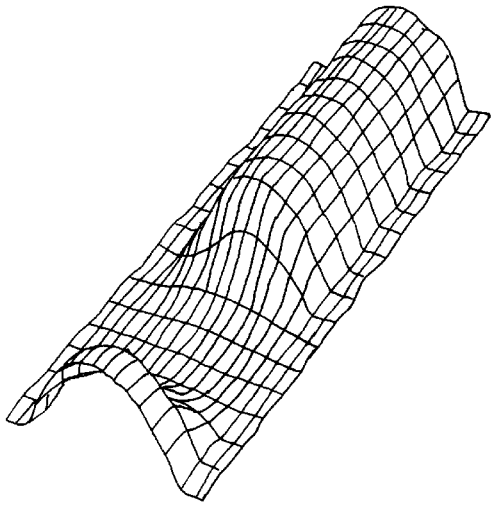
Fig. 2c
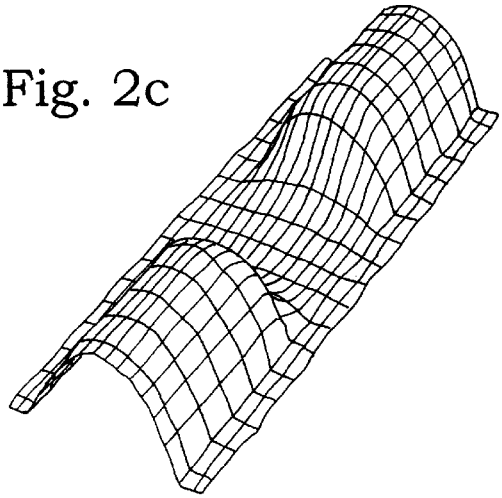
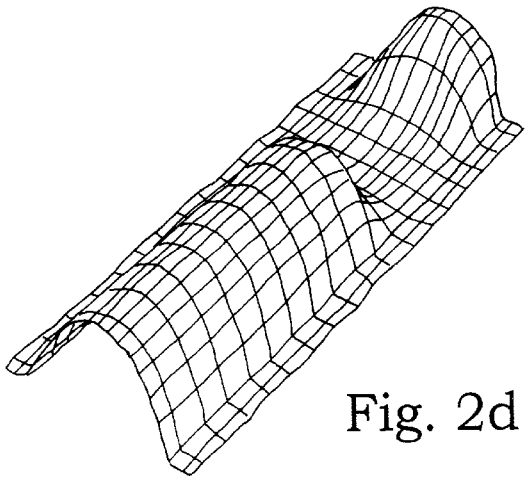
Fig. 2d

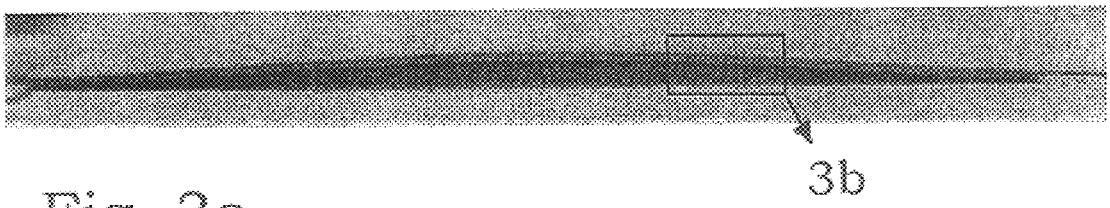
Fig. 3a
Fig. 3b
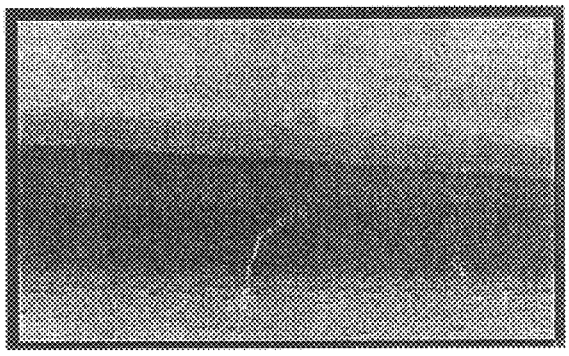
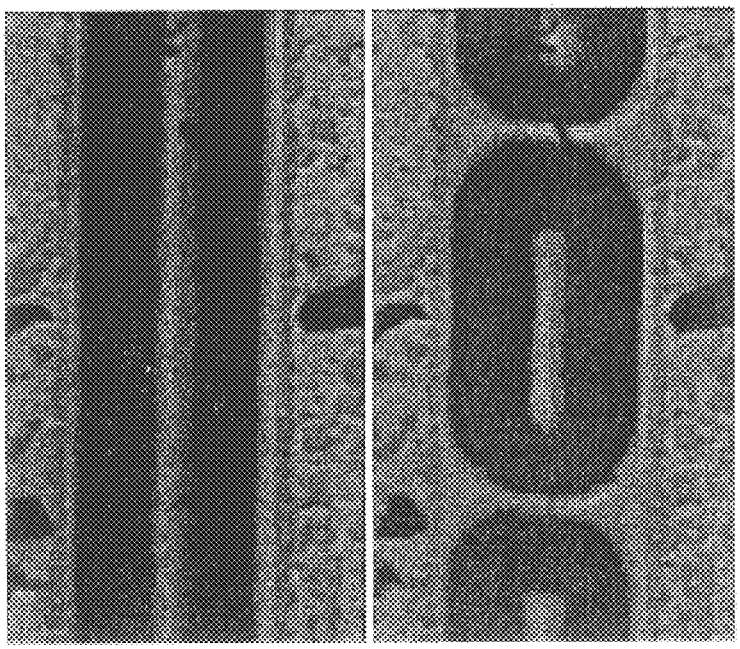
Fig. 3c

METHOD OF MANUFACTURE OF A SUSPENDED NITRIDE MEMBRANE AND A MICROPERISTALTIC PUMP USING THE SAME

RELATED APPLICATIONS

The present application is related to U.S. Provisional patent application Ser. No. 60/224,106 filed on Aug. 9, 2000.

GOVERNMENT SPONSORED RESEARCH

The U.S. Government has a paid-up license in this invention and the right in limited circumstances to require the patent owner to license others on reasonable terms as provided for by the terms of Grant No. N00014-99-1-0972 awarded by the Office of Naval Research.

BACKGROUND OF THE INVENTION

1. Field of the Invention

The invention relates to a peristaltic micro-pump fashioned in the column III-nitride material system as well as the broad processing technology used to fabricate suspended micro-devices in this same material system.

2. Description of the Prior Art

In designing the driving system of a biochip, three approaches have been used in the prior art. They are the on-chip mechanical micropump, the on-chip electro-kinetic micropump and the external servo system. An on-chip mechanical micropump may be prepared directly by the micro-machining technology. If this approach is adopted, a moveable part is provided inside the microchannel of the chip. The "electrostatically driven diaphragm micropump" shown by Roland Zengerle et al. in their U.S. Pat. No. 5,529,465 is a typical example. In the Zengerle device, the micropump includes a pressure chamber. Reciprocal pumping power is generated by electrostatics. With the help of two passive check valve, microflows are driven with a 350 mμl/min working velocity.

A simplified "micromachined peristaltic pump" was disclosed by Frank T. Hartley in U.S. Pat. No. 5,705,018. In this device, a series of block flexible conductive strips are positioned in the internal wall of a microchannel. When a voltage pulse passes along the microchannel, the flexible conductive strips are uplifted in sequence by the electrostatics so generated, such that a peristaltic movement is generated. This peristaltic movement drives the microflow along the microchannel. In the Hartley device, the working velocity is about 100 mμ/min.

The on-chip mechanical micropump does not provide the function such that the chip may be repeatedly used for different samples. This is because a microchannel with moveable parts is difficult to clean up residual samples or biochemical reagents after the reaction. Another problem is that the on-chip mechanical micropump, especially the peristaltic pump, involves expensive material costs. These biochips are not suited for disposable applications.

Micro-fluidic pumps fabricated in Column III-nitride materials offer several advantages over existing implementations. For one, Column III-nitride materials offer high chemical inertness and high temperature stability, making the micropumps suitable for harsh or corrosive environments. In addition, these micropumps can be readily integrated on a single chip with the broad spectrum of optoelectronic, high speed and high power devices possible in the Column III-nitride semiconductors. As described below, these micropumps employ a comparatively simple and reliable pumping mechanism. Furthermore, they are fabricated from a versatile processing technology which enables a broad range of device layouts for superior microscopic fluid control.

BRIEF SUMMARY OF THE INVENTION

The invention is a versatile processing technology for the fabrication of micro-electromechanical systems in GaN. This technology, which is an extension of conventional photo-electrochemical (PEC) etching, allows for the controlled and rapid undercutting of p-GaN epilayers. The control is achieved through the use of opaque metal masks to prevent etching in designated areas, while the high lateral etch rates are achieved by biasing the sample relative to the solution. For GaN microchannel structures processed in this way, undercutting rates in excess of 30 μm/min have been attained.

The invention is illustrated in the fabrication of a micropump comprising an electro-deformable membrane and a substrate disposed below the membrane and coupled thereto. A microchannel is defined between the membrane and substrate. The microchannel is formed so as to have a longitudinal axis. An electrode structure is disposed on at least one side of the membrane along side of the microchannel.

The electro-deformable membrane is bowed to form a curvature having a symmetrical axis in the direction of the longitudinal axis of the microchannel.

The micropump further comprises a drive circuit coupled to the electrode structure to apply a sequential voltage along the plurality of opposing electrodes to peristaltically deform the electro-deformable membrane in the direction of the longitudinal axis of the microchannel.

In the illustrated embodiment the electro-deformable membrane is composed of p-type GaN, but any material having the same or similar electro-deformable properties may be employed.

The micropump further comprises two opposing pillars disposed on the substrate between the substrate and the membrane generally aligned in the direction of the longitudinal axis. The two opposing pillars are composed of n-type GaN.

The electrode structure is comprised of two opposing electrode substructures extending parallel to the microchannel. The two opposing electrode substructures each comprise a plurality of discrete electrodes arranged and configured to provide pairs of opposing electrodes on each side of the microchannel. Many equivalent electrode structures to a series of opposing electrodes may be used, including propagation line electrodes in which a traveling wave potential may be placed. It may also be possible for a single electrode rail to be provided to provide the traveling wave potential with the opposing side of the membrane left to float or grounded by an opposing rail or any other conductive means.

The invention is also characterized as a method of micropumping comprising the steps of providing a bowed electro-deformable membrane disposed above a substrate and coupled thereto so that a microchannel is defined between the membrane and substrate. A traveling wave potential is propagated along the electro-deformable membrane in the direction of the longitudinal axis. As a consequence, the electro-deformable membrane is peristaltically deformed by the traveling wave potential and hence fluid is pumped in the microchannel along the longitudinal axis.

The step of providing a traveling wave potential comprises the step of applying a potential across the electro-deformable membrane traverse to the longitudinal axis and sequentially applied along the longitudinal axis. More specifically, in one embodiment the step of providing a traveling wave potential comprises sequentially applying a plurality of discrete potentials across the electro-deformable membrane traverse to the longitudinal axis.

The step of providing a bowed electro-deformable membrane comprises providing p-type GaN membrane and two opposing pillars composed of n-type GaN under the p-type GaN membrane to anchor and space the membrane apart from an underlying substrate. The illustrated method of making the bowed electro-deformable membrane comprises the step of forming the n-type GaN pillars and the p-type GaN membrane by selectively photo-electrochemical etching two adjacent n-type GaN and p-type GaN layers.

In general the step of providing a traveling wave potential is provided by an electrode structure of two opposing electrode substructures extending parallel to the microchannel. The electrode substructures may be continuous or discrete. In the illustrated embodiment the traveling wave potential is supplied by the two opposing electrode substructures comprises across a plurality of discrete electrodes which are arranged and configured to provide pairs of opposing electrodes on each side of the microchannel.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention can be better visualized by turning now to the following drawings wherein like elements are referenced by like numerals.

BRIEF DESCRIPTION OF THE DRAWINGS

FIGS. 2*a*–2*d* are computer simulation perspective net drawings of the membrane in isolation of other elements of the pump shown in a time sequence to illustrate the peristaltic pumping action.

FIG. 3*a* is a scanning electron microscopic photograph of a side view of a GN micro-pump of the invention, wherein the shaded region corresponds to the micro-channel for fluid flow.

FIG. 3*b* is a scanning electron microscopic photograph which shows an enlarged view of a section of the bowed 1.2$\mu$ p-GaN membrane.

FIG. 3*c* is a scanning electron microscopic photograph of a top plan view along the channel of a GaN micro-pump. On the left the dark strip running down the center corresponds to the suspended p-GaN film. On the right, a voltage has been applied across the channel causing the membrane to actuate or deflect. The direction of fluid flow is vertical in the images.

Figure 1:
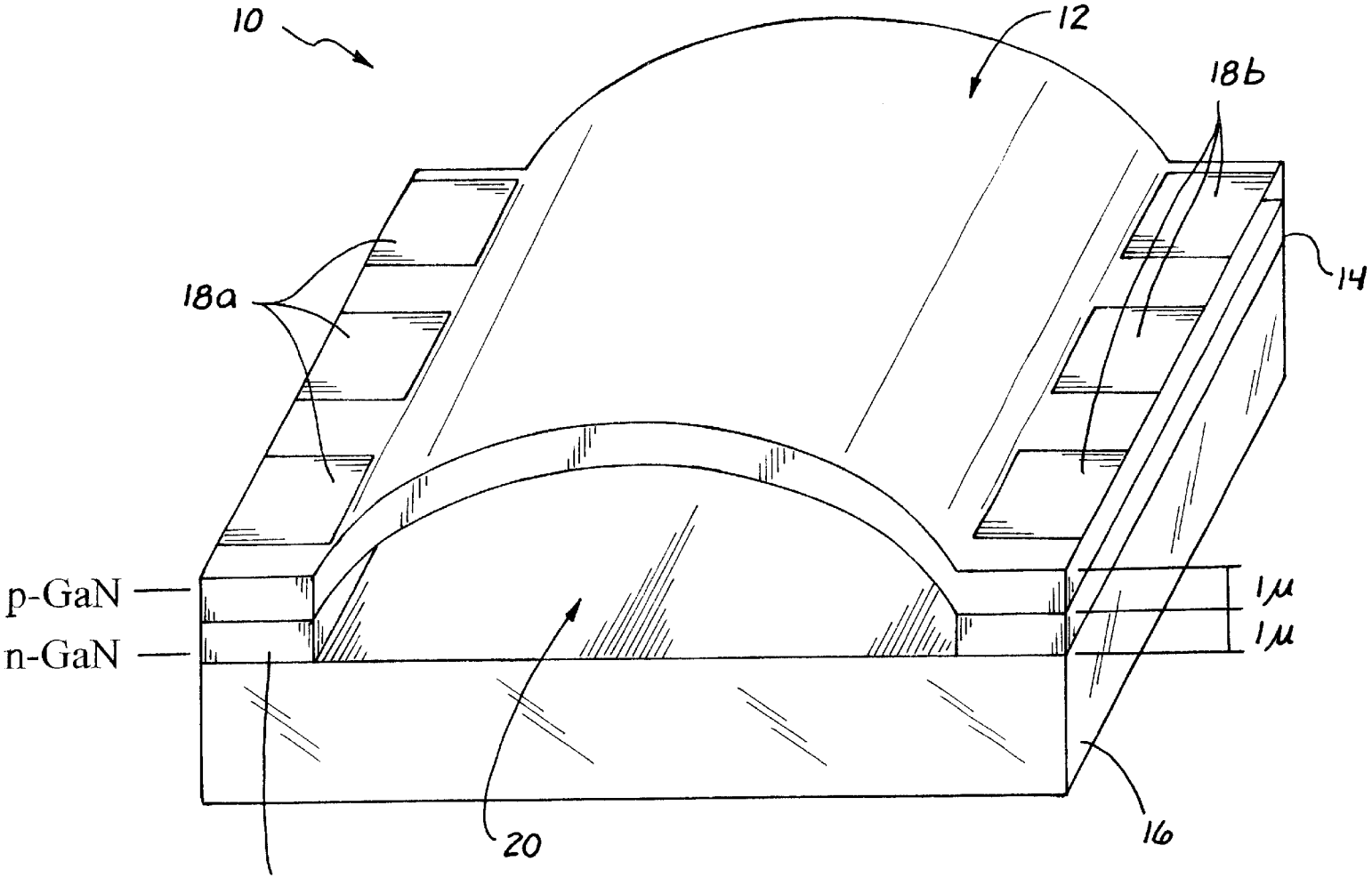
FIG. 1 is a simplified diagram of the principle parts of a GaN pump devised according to the invention.

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described below.

DETAILED DESCRIPTION OF THE PREFERRED EMBODIMENTS

In recent years, gallium nitride has established its place in the arena of solid-state devices, with applications ranging from light-emitting diodes and visible-blind photodetectors to high power Shottky diodes and ultra-fast high electron mobility transistors (HEMTs). Several material properties of GaN also make it a promising candidate for micro-electromechanical (MEMS) applications. Among the properties which set it apart from silicon, the conventional choice for MEMS, is its large piezoelectric response. This response would provide a powerful means for the excitation and detection of acoustic waves in micro-resonators. In addition, the strong piezoresistive effect in p-GaN is ideal for electrical strain sensing in micro-positioners. Furthermore, chemical inertness and high temperature stability make GaN a suitable choice for MEMS applications in harsh environments. Transparency to visible wavelengths also allows it to feature in optical micro-switches and waveguides. The methodology of the invention allows for the fabrication of a diverse range of suspended GaN microstructures.

The disclosed process exploits the dopant selectivity of photo-electrochemical (PEC) etching to undercut p-GaN layers grown on sacrificial n-GaN layers. PEC etching of GaN is achieved by exposing it to above bandgap radiation while immersed in an aqueous KOH solution. It is believed that band-bending at the n-GaN/electrolyte interface causes photogenerated holes to be swept toward the surface where they participate in the chemical dissolution of the semiconductor. In p-GaN, the bands bend in the opposite sense, creating a barrier for hole migration to the surface. Undercutting of p-GaN layers has also been observed and recently studied using backside illumination through the sapphire substrate. The fabrication of complex microstructures in GaN, however, requires that the undercutting be precisely controlled and optimized. First, etching must be prevented in regions of the n-type underlayer designed to provide mechanical anchoring for the p-type membrane above. Furthermore, for structures with a large undercut span, the lateral etch rate must be high to achieve a practical total etch time.

Photo-electrochemical etching (PEC) of column III-nitride (GaN, AlN, InN and their ternary alloys) can be used according to the methodology of the invention to fabricate a variety of micro-electromechanical devices, including but not limited to the micropump described above. For GaN, the PEC etching process is achieved by exposing the material to above bandgap UV radiation (<365 nm) in an aqueous etchant solution. Under these conditions, n-type doped GaN etches rapidly, while p-type GaN remains unaffected. This dopant selectivity of PEC etching, combined with the UV light sensitivity, allows for the fabrication of p-GaN suspended microstructures as illustrated in greater detail below in connection with FIGS. 4*a*–4*e*.

Figure 4D:
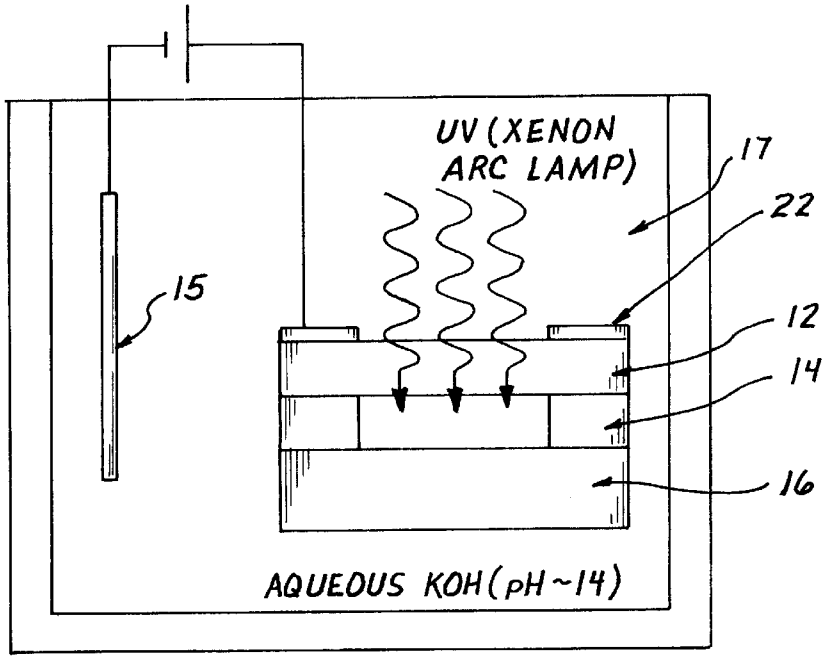
FIGS. 4*a*–4*e* are simplified cross-sectional side view of one methodology whereby the membrane of the invention may be fabricated.
Figure 4E:
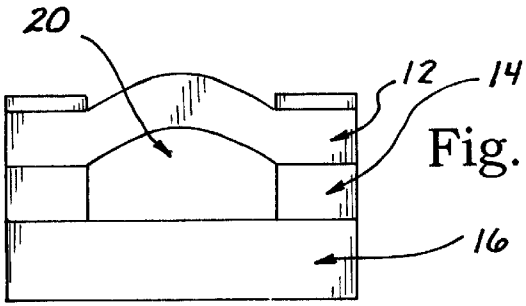
Figure 4A:
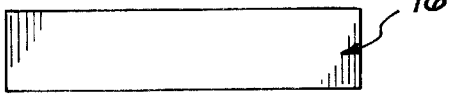
Figure 4B:
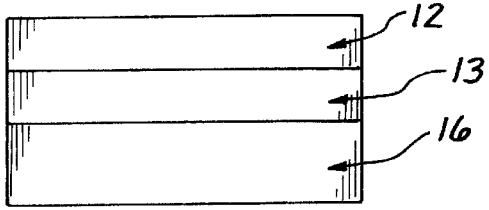
Figure 4C:
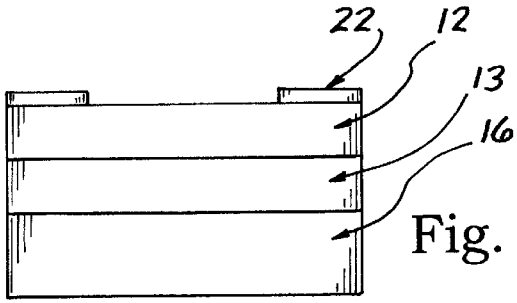

FIG. 4*a* is a side cross-sectional view of the beginning step of the method wherein a sapphire substrate 11 is provided. A sacrificial n-GaN base layer 13 is formed on substrate 11 as illustrated in FIG. 4*b*. A thin p-GaN layer or membrane 12 is grown epitaxially on sacrificial n-GaN base layer 13 as also shown in FIG. 4*b*. During the PEC process illustrated in FIGS. 4*a*–4*e*, a portion of n-GaN base layer 13 is selectively undercut or etched away, leaving the upper p-GaN membrane 12 freely suspended. This suspended membrane 12 is formed as follows. A patterned opaque metal mask 22 is deposited on the p-GaN over-layer 12 and is used to prevent UV exposure in certain areas of n-GaN base layer 13 during the etch step in FIG. 4*d*. This allows masked regions of the n-GaN base layer 13 to be locally protected from etching in order to leave structural support or pillars 14 for the thin p-GaN film 12 above. Large p-GaN areas can be undercut in this way, with lateral etch rates approaching 100 mm/min.

FIG. 4*d* shows the salient features of the etch setup used for controlled undercutting. In the illustrated embodiment, p-on-n bilayer samples 12, 13 were immersed in 0.1 M KOH and exposed from the front side by a Xenon arc lamp (not shown) with 100 mW/cm$^2$ in the UV. Prior to the PEC etch, opaque metal masks 22 (Ni/Au—80 nm/20 nm) were patterned onto the samples and then annealed at 500° C. for 5 minutes in Ar to prevent peeling in the corrosive bath. As indicated in the FIG. 4*d*, we observed that the n-type epilayer 13 does not etch in the areas immediately below the masks 22. However, masked regions near the outermost periphery of overlayer 12 undercut very slowly as a result of stray UV radiation that is reflected back through the sapphire substrate 11 directly into the n-GaN layer 13. To suppress this reflection, the samples 12, 13 were suspended in solution by a Ni wire epoxied near the side. This problem can be effectively eliminated by using backside polished substrates with a thin $SiO_2$ anti-reflection coating.

The Ni wire also served as an electrical contact to the p-GaN overlayer 12 during the PEC etch step. It was maintained at a positive 1.5 V bias with respect to a Pt cathode 15 in solution 17. The application of this bias was seen to dramatically accelerate the undercutting of the unmasked p-GaN areas 13, with lateral etch rates in excess of 30 $\mu$m/min being observed for certain geometries. The origins of this marked increase in etch rate are not well understood at this time. However, observations of the undercutting dynamics suggest that the sample bias gives rise to drift currents of the electrolyte within the narrow etched channels under the p-GaN film 12. We suspect these currents deliver chemically active $OH^-$ radicals to the etch front much more efficiently than diffusion alone.

What results is the microchannel 20 shown in FIG. 4*e* which is described in greater detail below. An example of one of the devices that are possible with this processing technology is a micro-fluidic pump 10 depicted in the perspective view of FIG. 1. The pump 10 is comprised of a p-GaN membrane 12 suspended between two opposing, parallel n-GaN support pillars 14 which are anchored to a rigid substrate 16 below pillars 14. As depicted in FIG. 1, the p-GaN membrane 12 bows upward between the rigid support pillars 14 to relieve compressive strain in the film resulting from the original epitaxial growth process. This bowing substantially increases the volume of the enclosed micro-channel 20 defined between membrane 12 and substrate 16 below. The amount of bowing and the strain developed in membrane 12 can be varied according to conventional means to assume a wide variety of values. The termination of the longitudinal ends of microchannel 20 may be completed in any one of a number of ways using conventional micromaching techniques, such as chemically assisted ion beam etching (CAIBE), all of which are considered equivalent for the purposes of the present invention. Opposing sets of metallic contact pads 18*a* and 18*b* can then be patterned above the support pillars on the upper surface of p-GaN membrane 12 using standard lithographic techniques. These metal pads provide electrical contact to the micro-channel for the purpose of electro-actuation of the pump.

The micropump having now been described in general terms, consider the fabrication of the suspended membrane 12 of FIG. 1 in greater detail. An example of the diverse microstructures which can be realized using this etch process is the GaN microchannel shown in FIG. 1. The microchannel 20 is comprised of an 1 $\mu$m thick p-GaN membrane 12 that spans between two long anchoring strips 14 on either side. To fabricate this structure, a series of Ni/Au bars (not shown, but later divided into pads 18*a* and 18*b*) with 100 $\mu$m spacing between the bars across was to become channel 20 were patterned on a p-on-n bilayer sample 12, 13 using standard lithographic techniques. The sample was then exposed to the PEC etch described above, during which the unmasked regions between the bars were undercut. Etching of n-GaN underlayer 13 proceeded inward from both sides in the direction of the bars. A total undercut channel length of 5 $\mu$m etched to completion in roughly 2 hours. Afterward, the metal masks were removed in places, leaving a series of isolated contact pads 18*a* and 18*b* along the anchored sidewalls.

The GaN layers 13 used here were grown by molecular beam epitaxy on c-plane sapphire 11 with no buffer layer. Both the n+ (Si) and the p+ (Mg) epilayers are 1 $\mu$m thick, and the growth temperature in each case was 800° C. and 700° C. respectively. Both layers are thought to have carrier concentrations in the range of $10^{18}$/cm$^3$.

The surface quality of the p-type film 12 does not appear to degrade as a result of the lengthy PEC etch. Furthermore, the underside of the suspended p-GaN film 12 is smooth and featureless. This is in marked contrast to our observations of MOCVD grown p-on-n samples, for which the undersides are rough and coated with etch-resilient whiskers.

As seen in FIG. 1, the p-GaN membrane 12 bows upward after release to relieve inherent stress. A maximum vertical deflection of 9.2 $\mu$m is measured at the center of the 100 $\mu$m channel width. We believe the primary origin of this stress is the thermal mismatch between the GaN epilayer 13 and the sapphire substrate 11, integrated down from growth temperatures. Measurements of the expanded length of the bowed film correspond to a biaxial compressive strain of $1.0\times10^{-3}$ in the p-GaN layer prior to release. However, we have observed strong evidence that the stress profile in the p-layer 12 is far more complicated: p-GaN cantilever structures relax into a shape which is uniformly curved away from the substrate 11. This bending suggests there are vertical stress gradients in the p-layer 12, perhaps built in at the time of growth as a result of the different lattice constants for Mg and Si doped GaN.

Consider now the method of operating the pump of FIG. 1. By applying a voltage across a pair of opposing metal contacts 18*a* and 18*b*, membrane 12 can be made to flatten locally in the intervening region between pillars 14. Sequential actuation of membrane 12 in this manner will induce a peristaltic wave motion along the length of device 10, as depicted in FIGS. 2*a*–2*b*–2*c*–2*d*, which are computer simulation perspective net drawings of membrane 12 in isolation of other elements of pump 10 shown in a time sequence. FIG. 2*a* shows membrane 12 in equilibrium without any applied voltage to it. The remaining images of FIGS. 2*b*–2*d* show membrane 12 actuated at successive points along its length by sequential application of a voltage to opposing pairs of contacts 18*a* and 18*b* along the edges of membrane 12. A constriction of membrane 12 can be seen in the sequence of FIGS. 2*a*–2*d* moving from left to the right end of membrane 12 as seen in the view of the drawings. This wave motion can be used to pump fluids down the length of the micro-channel 20 with a peristaltic wave motion.

Several GaN micro-pumps have been successfully fabricated and tested with varying channel widths and lengths. FIG. 3*a* is a scanning electron-microscope perpendicular cross-sectional side-view image of a pump 10 with no applied bias. FIG. 3*b* is an enlarged cross-sectional side-view image of a portion of FIG. 3*a*. The width of the channel measured between pillars 14 is 200 $\mu$m, and the maximum vertical deflection of the p-GaN membrane 12 above the substrate 16 is 10 $\mu$m.

Optical microscope images of a top plan view along the length parallel to pillars 14 of device 10 of FIG. 3*a* are displayed in FIG. 3*c* with the bowed p-GaN membrane 12 viewed from above. On the left half of FIG. 3*c*, the membrane 12 is in equilibrium without external bias. On the right half of FIG. 3*c* a voltage is applied across the channel 20 has caused membrane 12 to flatten locally. With the aid of a conventional timing circuit to apply voltage sequentially along the longitudinal length of channel 20, peristaltic motion has been successfully demonstrated in these devices. For the channel depicted in FIG. 3, the voltage required to cause full constriction of the membrane is approximately 20 V. At a fixed point along the longitudinal axis, a complete actuation cycle can be performed at a maximum rate of 100 Hz. With a spacing of 100 $\mu$m between contact pads along the longitudinal axis, the peristaltic wave velocity down the channel is roughly 1 cm/s. The corresponding pumping capacity of the channel in FIG. 3 is 0.01 $\mu$L/s.

Thus, it can now be readily understood that the versatile PEC processing methodology can be used to create either p or n type nitride suspended membranes of variable bowing or curvature for use in a wide variety of microdevices of which the micropump 10 is only one of a myriad of possibilities. It is to be expressly understood that the method of making the nitride suspended membrane is generally applicable as a fabrication technique for the manufacture of a membrane element in any device now known or later devised.

GaN micro-pump 10 provide a technologically convenient way to control fluid motion in microscopic channels 20. These pumps 10 could find application in a large range of settings, wherever peristaltic pumping of fluid in a microfluidic device or hydraulic circuit is needed, including without limitation fuel cells, water filtration, blood regulation, and micro-chemical analysis devices.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the invention.

We claim:

1. A micropump comprising:

an electro-deformable membrane;

a substrate disposed below said membrane and coupled thereto, a microchannel defined between said membrane and substrate, said microchannel having a longitudinal axis; and an electrode structure disposed on at least one side of said membrane along side of said microchannel.

2. The micropump of claim 1 said electro-deformable membrane is bowed to form a curvature having a symmetrical axis in the direction of said longitudinal axis of said microchannel.

3. The micropump of claim 1 further comprising a drive circuit coupled to said electrode structure to apply a sequential voltage along said plurality of opposing electrodes to peristaltically deform said electro-deformable membrane in the direction of said longitudinal axis of said microchannel.

4. The micropump of claim 1 where said electro-deformable membrane is composed of p-type GaN.

5. The micropump of claim 2 where said electro-deformable membrane is composed of p-type GaN.

6. The micropump of claim 1 further comprising two opposing pillars disposed on said substrate between said substrate and said membrane generally aligned in the direction of said longitudinal axis.

7. The micropump of claim 2 further comprising two opposing pillars disposed on said substrate between said substrate and said membrane generally aligned in the direction of said longitudinal axis.

8. The micropump of claim 3 further comprising two opposing pillars disposed on said substrate between said substrate and said membrane generally aligned in the direction of said longitudinal axis.

9. The micropump of claim 5 further comprising two opposing pillars disposed on said substrate between said substrate and said membrane generally aligned in the direction of said longitudinal axis.

10. The micropump of claim 9 where said two opposing pillars are composed of n-type GaN.

11. The micropump of claim 1 where said electrode structure is comprised of two opposing electrode substructures extending parallel to said microchannel.

12. The micropump of claim 11 where said two opposing electrode substructures each comprise a plurality of discrete electrodes arranged and configured to provide pairs of opposing electrodes on each side of said microchannel.

13. A method of micropumping comprising:

providing a bowed electro-deformable membrane disposed above a substrate and coupled thereto so that a microchannel is defined between said membrane and substrate, said microchannel having a longitudinal axis;

providing a traveling wave potential propagating along said electro-deformable membrane in the direction of said longitudinal axis; and deforming said electro-deformable membrane by said traveling wave potential to pump fluid in said microchannel along said longitudinal axis.

14. The method of claim 13 where providing a traveling wave potential comprises applying a potential across said electro-deformable membrane traverse to said longitudinal axis and sequentially applied along said longitudinal axis.

15. The method of claim 13 where providing a traveling wave potential comprises sequentially applying a plurality of discrete potentials across said electro-deformable membrane traverse to said longitudinal axis.

16. The method of claim 13 where providing a bowed electro-deformable membrane comprises providing p-type GaN membrane.

17. The method of claim 13 where providing a bowed electro-deformable membrane further comprises providing two opposing pillars composed of n-type GaN under said p-type GaN membrane to anchor and space said membrane apart from an underlying substrate.

18. The method of claim 17 where providing a bowed electro-deformable membrane comprises forming said n-type GaN pillars and said p-type GaN membrane by selectively photo-electrochemical etching two adjacent n-type GaN and p-type GaN layers.

19. The method of claim 13 where providing a traveling wave potential is provided by an electrode structure of two opposing electrode substructures extending parallel to said microchannel.

20. The method of claim 19 where providing a traveling wave potential by said two opposing electrode substructures comprises applying said traveling wave potential across a plurality of discrete electrodes arranged and configured to provide pairs of opposing electrodes on each side of said microchannel.

* * * * *